US010807366B2

(12) United States Patent
Fukuzawa et al.

(10) Patent No.: US 10,807,366 B2
(45) Date of Patent: Oct. 20, 2020

(54) LIQUID EJECTING HEAD AND LIQUID EJECTING APPARATUS

(71) Applicant: SEIKO EPSON CORPORATION, Tokyo (JP)

(72) Inventors: Yuma Fukuzawa, Matsumoto (JP); Motoki Takabe, Shiojiri (JP); Shunsuke Watanabe, Matsumoto (JP); Akira Miyagishi, Matsumoto (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/455,924

(22) Filed: Jun. 28, 2019

(65) Prior Publication Data

US 2020/0001603 A1 Jan. 2, 2020

(30) Foreign Application Priority Data

Jun. 29, 2018 (JP) ..... 2018-124366

(51) Int. Cl.
*B41J 2/14* (2006.01)
*B41J 2/055* (2006.01)
*B41J 2/16* (2006.01)

(52) U.S. Cl.
CPC ..... *B41J 2/1433* (2013.01); *B41J 2/055* (2013.01); *B41J 2/1607* (2013.01)

(58) Field of Classification Search
CPC ..... B41J 2/1433; B41J 2/055; B41J 2/1404; B41J 2/18; B41J 2/14233; B41J 2202/12
See application file for complete search history.

(56) References Cited

U.S. PATENT DOCUMENTS

2012/0176450 A1 7/2012 Akahane et al.
2016/0279930 A1* 9/2016 Date ..... B41J 2/04541
2016/0311221 A1* 10/2016 Menzel et al. ..... B41J 2/1433
2018/0297357 A1 10/2018 Menzel et al.
2019/0366717 A1 12/2019 Tsukahara et al.

FOREIGN PATENT DOCUMENTS

JP 2012-143948 8/2012
JP 2017165051 9/2017
WO 2018116846 6/2018

* cited by examiner

*Primary Examiner* — Juanita D Jackson
(74) *Attorney, Agent, or Firm* — Workman Nydegger

(57) ABSTRACT

A flow path forming substrate on which a nozzle plate including a plurality of nozzles is mounted forms a supply flow path from a shared supply path shared for liquid supply to the plurality of nozzles, and an individual supply path branching from the shared supply path and leading to a pressure chamber for each of the nozzles, and forms a collecting flow path from an individual collecting path for each of the nozzles communicated with the communication flow path for each of the nozzles communicating with the nozzles and pressure chambers, and a shared collecting path shared for liquid collection from the plurality of nozzles by joining to the individual collecting path. The shared supply path is liquid-tightly closed by a supply-side flexible plate having flexibility, and the collecting flow path is liquid-tightly closed by a collecting-side flexible plate having flexibility over a flow path area.

7 Claims, 9 Drawing Sheets

LIQUID EJECTING HEAD AND LIQUID EJECTING APPARATUS

The present application is based on, and claims priority from JP Application Serial Number 2018-124366, filed Jun. 29, 2018, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting apparatus ejecting a liquid from a nozzle is used, for example, as an ink jet type printing apparatus ejecting ink that is a liquid. In such a printing apparatus, since printing quality is deteriorated due to an increase in viscosity of the ink and sedimentation of an ink component, a method of circulating and supplying the ink to a pressure chamber that causes a change in ink ejection pressure has been proposed (for example, JP-A-2012-143948). In JP-A-2012-143948, in order to supply and discharge the ink to and from the pressure chamber for each nozzle, a supply-side flow path to the pressure chamber is constituted as a shared flow path and an individual flow path for each nozzle separated from the shared flow path, and a collecting-side flow path from the pressure chamber also adopts an individual flow path for each nozzle and a shared flow path to which the individual flow path is joined. Then, a flow path area of the collecting-side shared flow path is closed by a nozzle plate having the nozzles, and the supply-side shared flow path is closed by a flexible compliance sheet in the flow path area.

Suppression of sedimentation of the ink component or the like after circulation and supply of the ink to the pressure chamber described in JP-A-2012-143948 contributes to improvement of printing quality, but as will be described later, there is room for improvement of the printing quality from another viewpoint. The ink that has received an ink ejecting pressure is ejected from the nozzle, but the ink not ejected flows into the shared flow path via the collecting-side individual flow path. The ink flowed into the collecting-side shared flow path is joined to ink to be newly ejected via a flow path. In addition, the collecting-side shared flow path is closed by a nozzle plate having resistance to an ink ejection pressure applied to the pressure chamber. Therefore, when a pressure fluctuation due to the immediately preceding ejection remains in the ink of the collecting-side shared flow path, the ink to be newly ejected may be affected. As a result, there was a concern that fluctuation in the ejection amount ejected from the nozzle occurred, which may cause deterioration in printing quality. Such an event can occur not only in an ink jet type printing apparatus but also in another liquid ejecting apparatus.

SUMMARY

According to one aspect of the present disclosure, there is provided a liquid ejecting head. The liquid ejecting head having a plurality of nozzles ejecting a liquid, the liquid ejecting head including: a nozzle plate having the plurality of nozzles; a flow path forming substrate on which the nozzle plate is mounted and which includes a shared supply path shared for liquid supply to the plurality of nozzles, an individual supply path branching from the shared supply path and leading to a pressure chamber for each of the nozzles, a communication flow path for each of the nozzles communicating the nozzles and the pressure chamber to each other, an individual collecting path communicating with the communication flow path for each of the nozzles, and a shared collecting path shared for liquid collection from the plurality of nozzles by joining to the individual collecting path; a pressure generating section provided for each of the nozzles to change a pressure of the pressure chamber; a supply-side flexible plate having flexibility and liquid-tightly closing the shared supply path formed by the flow path forming substrate over a flow path area; and a collecting-side flexible plate having flexibility and liquid-tightly closing the shared collecting path formed by the flow path forming substrate over the flow path area.

DESCRIPTION OF EXEMPLARY EMBODIMENTS

A. First Embodiment

Figure 1:
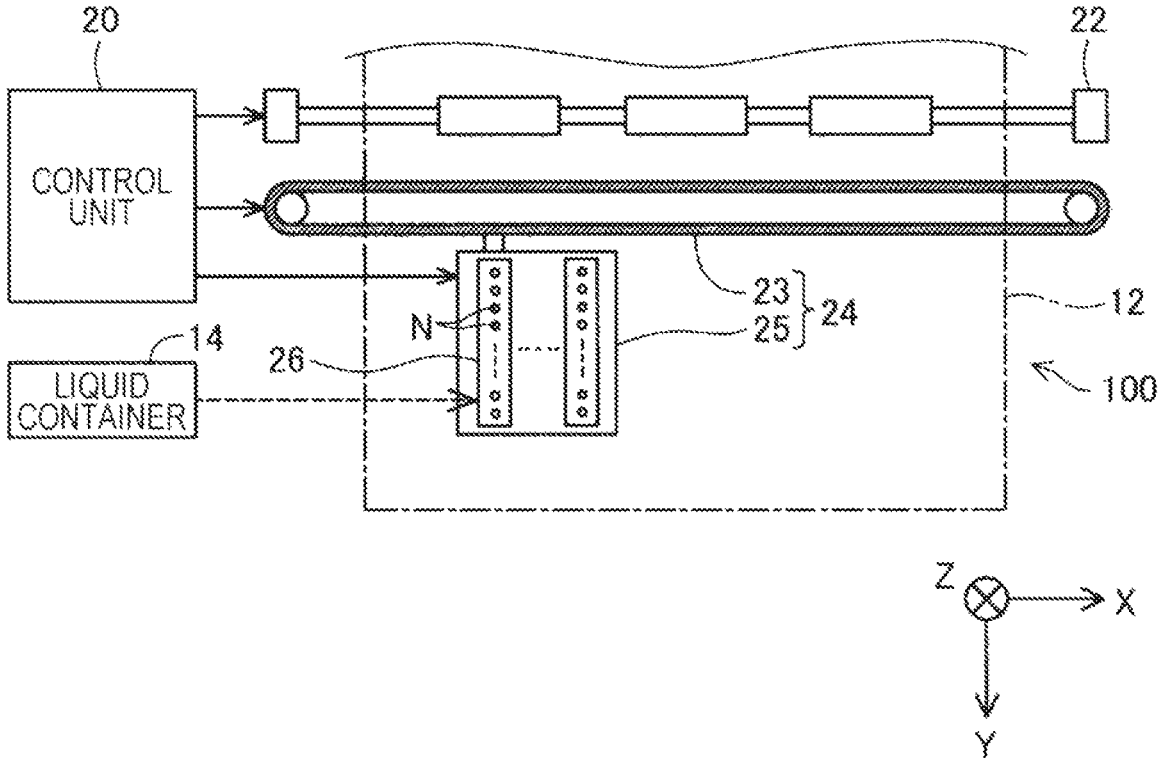
FIG. 1 is an explanatory view schematically illustrating a configuration of a liquid ejecting apparatus according to a first embodiment of the present disclosure.

FIG. 1 is an explanatory view schematically illustrating a configuration of a liquid ejecting apparatus 100 according to a first embodiment of the present disclosure. The liquid ejecting apparatus 100 is an ink jet type printing apparatus ejecting liquid droplets of ink, which is an example of a liquid, onto a medium 12. Hereinafter, ejection of the liquid droplets of the ink is simply referred to as ink ejection. The liquid ejecting apparatus 100 uses the medium 12 which is a print target of any material such as a resin film or cloth in addition to printing sheet, and performs printing on these various kinds of the medium 12. Respective drawings including FIG. 1, among an X direction, a Y direction, and a Z direction orthogonal to each other, the X direction is a transporting direction (main scanning direction) of a liquid ejecting head 26 described later, the Y direction is a medium feeding direction (sub-scanning direction) orthogonal to the main scanning direction, and the Z direction is an ink ejecting direction and a vertical direction orthogonal to an XY plane. In the following description, for convenience of description, the main scanning direction will be appropriately referred to as a printing direction. In addition, when specifying the directions, positive and negative signs are used in the directions in which an illustrated direction is + (positive). Moreover, the ink ejecting direction may be the vertical direction or a direction intersecting the vertical direction. The liquid ejecting apparatus 100 may be a so-called line printer in which the medium feeding direction (sub-scanning direction) coincides with the transporting direction (main scanning direction) of the liquid ejecting head 26.

The liquid ejecting apparatus 100 includes a liquid container 14, a transport mechanism 22 for sending out the medium 12, a control unit 20, a head moving mechanism 24, and the liquid ejecting head 26. The liquid container 14 individually stores plural kinds of ink ejected from the liquid ejecting head 26. As the liquid container 14, a bag-like ink pack formed of a flexible film, an ink tank capable of replenishing ink, or the like can be used.

The control unit 20 includes a processing circuit such as a Central Processing Unit (CPU) or a Field Programmable Gate Array (FPGA) and a memory circuit such as a semiconductor memory, and totally controls the transport mechanism 22, the head moving mechanism 24, the liquid ejecting head 26, and the like. The transport mechanism 22 operates under the control of the control unit 20 and sends out the medium 12 in a +Y direction.

The head moving mechanism 24 includes a transport belt 23 wound around over a printing range of the medium 12 in the X direction, and a carriage 25 accommodating the liquid ejecting head 26 and fixing the liquid ejecting head 26 to the transport belt 23. The head moving mechanism 24 operates under the control of the control unit 20 and causes the liquid ejecting head 26 to reciprocate in the main scanning direction (X direction) together with the carriage 25. When the carriage 25 reciprocates, the carriage 25 is guided by a guide rail (not illustrated). A head configuration, in which the liquid container 14 is mounted on the carriage 25 together with the liquid ejecting head 26, may be provided.

The liquid ejecting head 26 is prepared for each color of ink stored in the liquid container 14, and ejects the ink, which is supplied from the liquid container 14, from a plurality of nozzles N onto the medium 12 under the control of the control unit 20. A desired image or the like is printed on the medium 12 by ejecting the ink from the nozzles N during the reciprocation of the liquid ejecting head 26. As illustrated in FIG. 1, the liquid ejecting head 26 includes a nozzle row in which a plurality of nozzles N are arranged in the sub-scanning direction.

Figure 2:
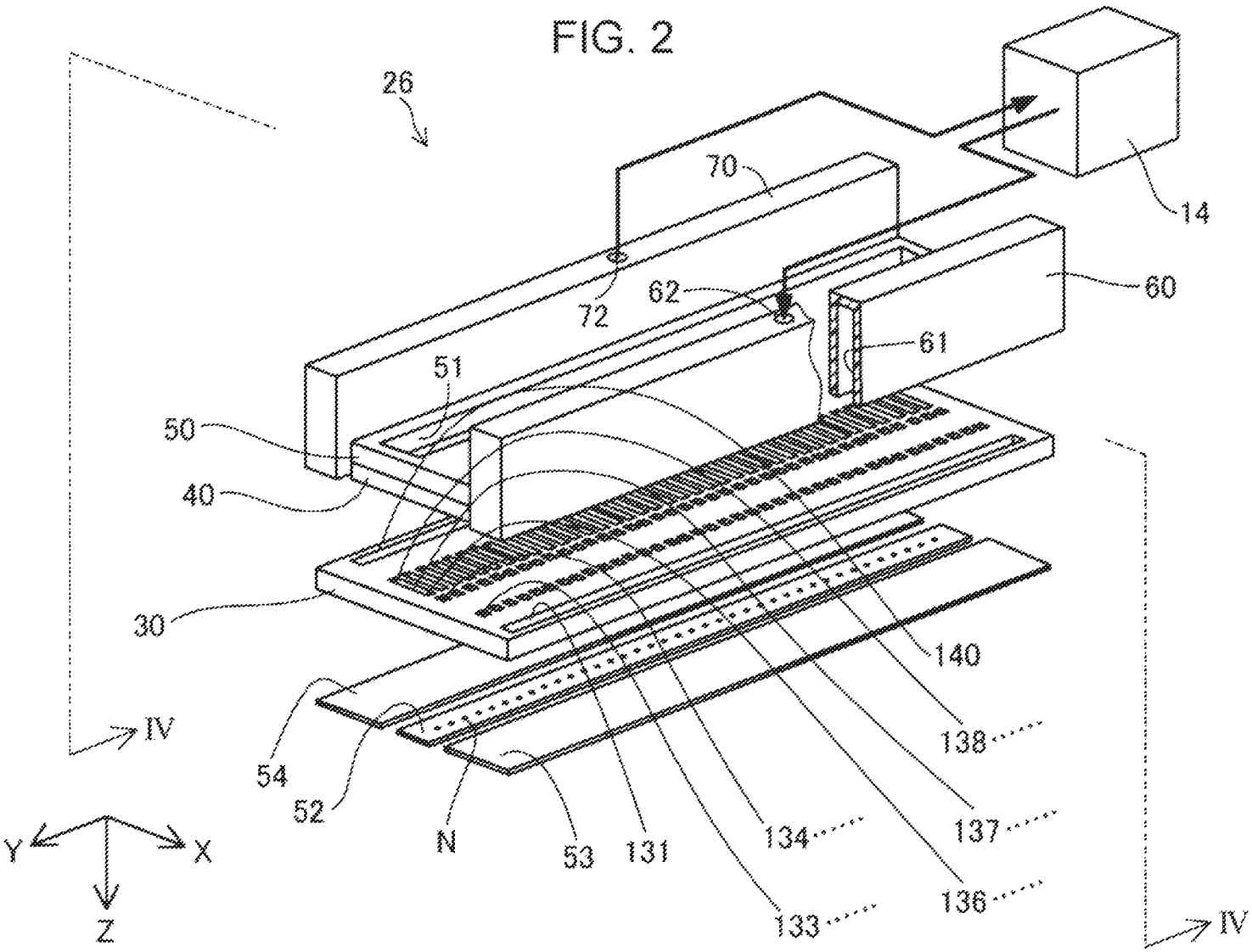
FIG. 2 is an explanatory view schematically illustrating main head configuration members of a liquid ejecting head in an exploded view from above.
Figure 3:
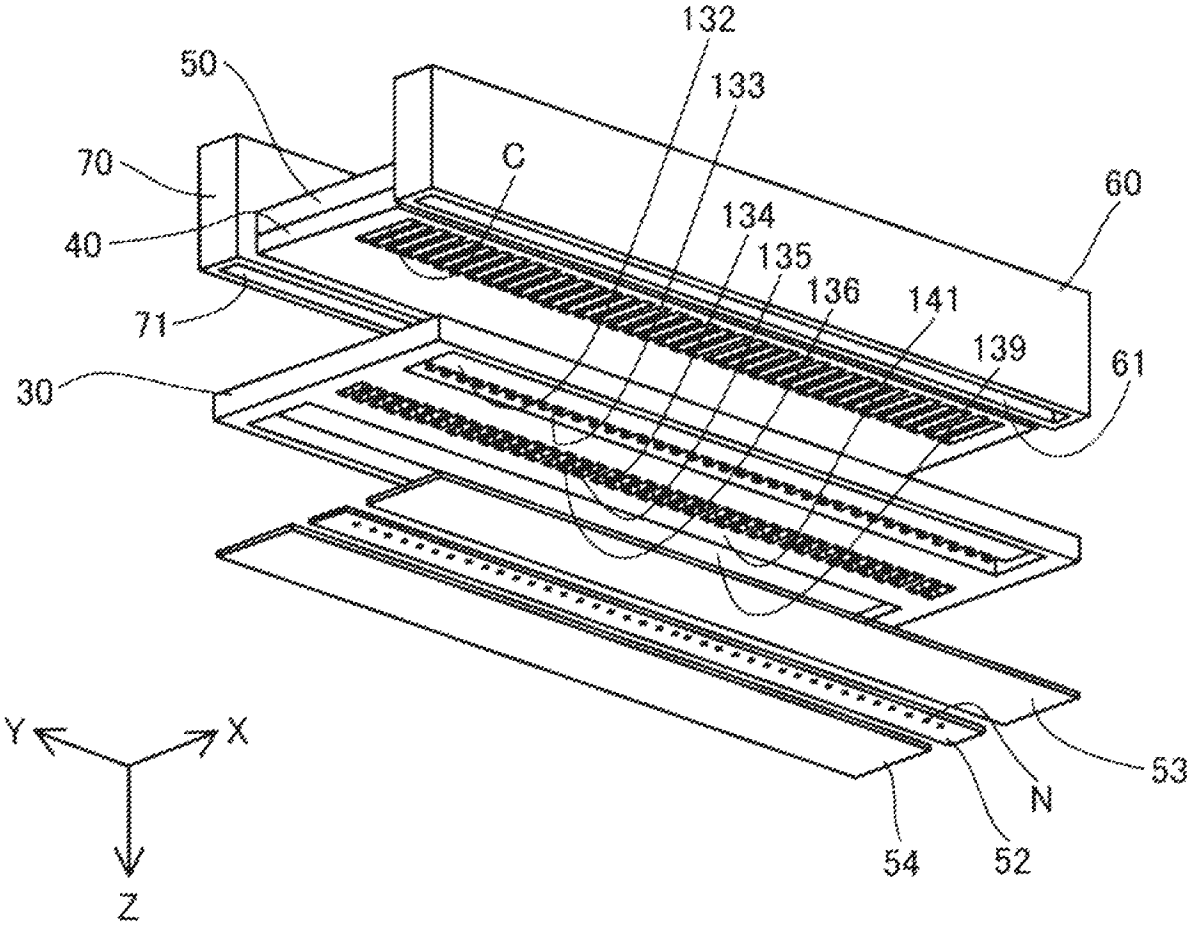
FIG. 3 is an explanatory view schematically illustrating the main head configuration members of the liquid ejecting head in an exploded view from below.
Figure 4:
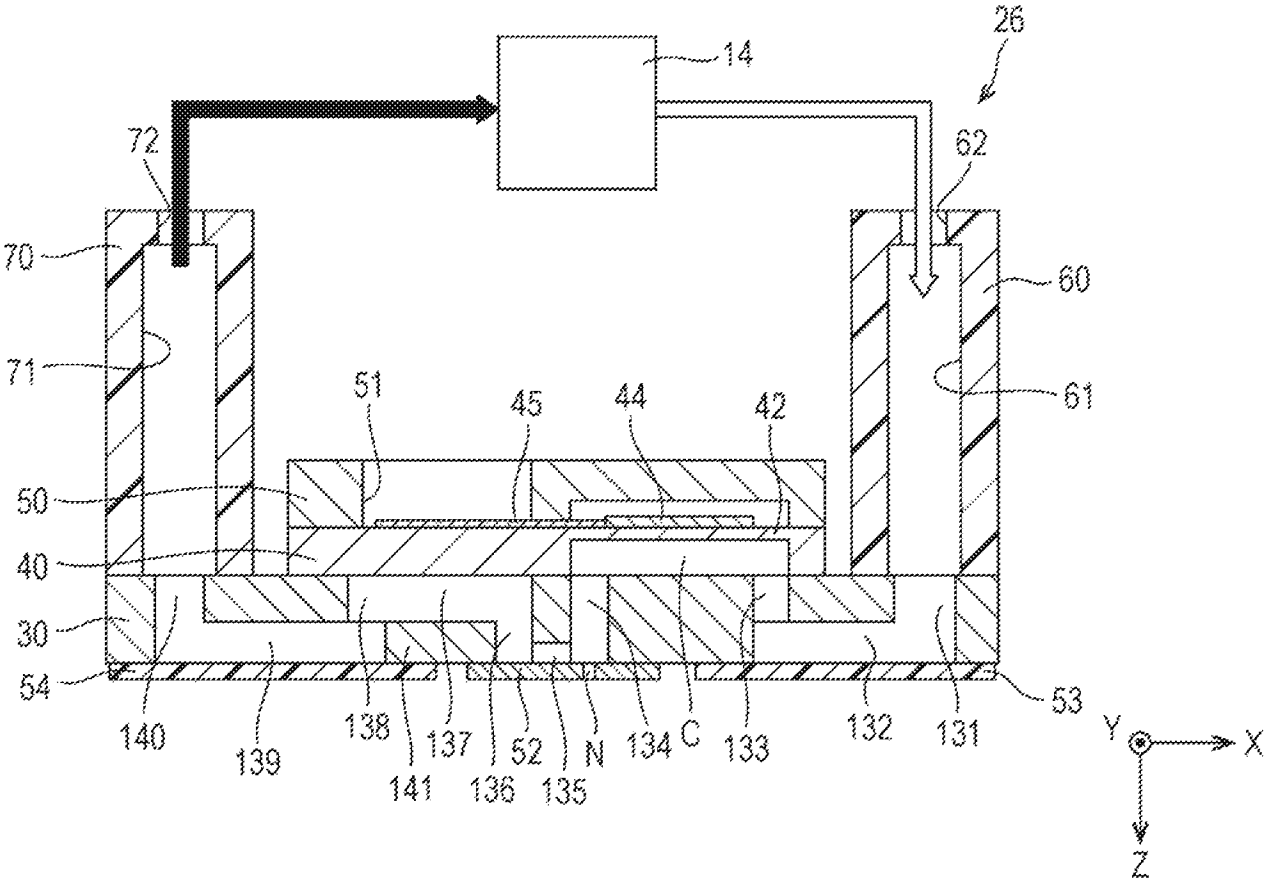
FIG. 4 is an explanatory view illustrating the liquid ejecting head in a sectional view which is taken along line IV-IV in FIG. 2.

The liquid ejecting head 26 is a laminated body in which head configuration elements are laminated in the Z direction. FIG. 2 is an explanatory view schematically illustrating main head configuration members of the liquid ejecting head 26 in an exploded view from above. FIG. 3 is an explanatory view schematically illustrating the main head configuration members of the liquid ejecting head 26 in an exploded view from below. FIG. 4 is an explanatory view illustrating the liquid ejecting head 26 in a sectional view which is taken along line IV-IV in FIG. 2. A thickness of each of illustrated configuration members does not indicate an actual thickness of each of the configuration members.

As illustrated in the drawing, the liquid ejecting head 26 includes, as main head configuration elements, a flow path forming substrate 30 forming various flow paths described below in the head, a pressure chamber plate 40 forming a pressure chamber C for each of the nozzles N, a protection substrate 50 for mounting and protecting a piezoelectric element 44 described below as a pressure generating section, a supply flow path substrate 60 for supplying ink, and a collecting flow path substrate 70 for collecting the ink. The supply flow path substrate 60 and the collecting flow path substrate 70 may be formed integrally or separately. In addition, a supply-side flexible plate 53 and a collecting-side flexible plate 54 may be formed integrally or separately. The pressure generating section may be a heat generating element that generates heat, may be an electrostatic element, or may be a MEMS element in order to cause a pressure change in ink with which the pressure chamber C is filled.

The flow path forming substrate 30 is an elongated plate body which is longer in the Y direction than in the X direction in a plan view in the Z direction, the supply flow path substrate 60 and the collecting flow path substrate 70 are mounted on a substrate upper surface in a −Z direction, the pressure chamber plate 40 and the protection substrate 50 are mounted between the supply flow path substrate 60 and the collecting flow path substrate 70 in a laminated state. In addition, a nozzle plate 52, the supply-side flexible plate 53, and the collecting-side flexible plate 54 are mounted on a substrate lower surface of the flow path forming substrate 30 in a +Z direction. As described below, the flow path forming substrate 30 is formed by combining various flow paths to through-holes or recess grooves provided in the flow path forming substrate 30. The through-holes may be holes penetrating the flow path forming substrate 30 in the Z direction, or the recess grooves may be grooves which do not penetrate the flow path forming substrate 30 in the Z direction. In addition, the recess grooves on the substrate lower surface are closed by the nozzle plate 52, the supply-side flexible plate 53, and the collecting-side flexible plate 54, so that the flow path forming substrate 30 forms flow paths between the nozzle plate 52, the supply-side flexible plate 53, and the collecting-side flexible plate 54. Hereinafter, each plate configuration will be described in association with flow path formation from a supply side to a collecting side of the ink.

The supply flow path substrate 60 is a plate body elongated in the Y direction and includes an ink receiving chamber 61 therein. The recess grooves, of which lower ends are open and which extend in the Y direction, are closed by the flow path forming substrate 30, so that the ink receiving chamber 61 is formed and receives the ink supplied from the liquid container 14 via an ink introduction port 62 as indicated by a white arrow in FIG. 4. The supply flow path substrate 60 is formed by injection molding of an appropriate resin material.

The flow path forming substrate 30 includes an ink inflow chamber 131, a supply liquid chamber 132, a supply flow path 133, a nozzle communication flow path 134, a collecting communication flow path 135, a first collecting flow path 136, a second collecting flow path 137, a third collecting flow path 138, an ink collecting chamber 139, and an ink discharge chamber 140 in this order from a mounting side of the supply flow path substrate 60.

As illustrated in FIG. 2, the ink inflow chamber 131 is a rectangular opening penetrating the flow path forming substrate 30 in the Z direction and elongated in the Y direction, and overlaps with the ink receiving chamber 61 of the supply flow path substrate 60. As illustrated in FIGS. 3 and 4, the supply liquid chamber 132 is a recess groove, which is a common liquid chamber continuous with the ink inflow chamber 131 to communicate with a plurality of pressure chambers C that are long in the Y direction and have openings, on the substrate lower surface of the flow path forming substrate 30, and is formed by being closed by the supply-side flexible plate 53 mounted on the substrate lower surface of the flow path forming substrate 30 over the flow path area. As illustrated in FIGS. 2 and 4, the supply flow path 133 is a through-hole for each of the nozzles N, which penetrates the flow path forming substrate 30 in the Z direction to reach the supply liquid chamber 132, and causes the pressure chamber C for each of the nozzles N to communicate with the supply liquid chamber 132 on one end side of the pressure chamber. As illustrated in FIGS. 2 and 4, the pressure chamber C is a recess groove formed in the X direction for each of the nozzles N on a lower surface of the pressure chamber plate 40, and is formed by pinching and mounting the pressure chamber plate 40 on the substrate upper surface of the flow path forming substrate 30 by the protection substrate 50. Moreover, mounting of the supply flow path substrate 60 and the supply-side flexible plate 53 on the flow path forming substrate 30, and pinching and mounting of the pressure chamber plate 40 on the flow path forming substrate 30 by the protection substrate 50 are liquid-tightly performed by using an appropriate adhesive.

In the supply flow path for supplying the ink from the ink receiving chamber 61 of the supply flow path substrate 60 to the pressure chamber C, the ink inflow chamber 131 and the supply liquid chamber 132 communicated therewith are a shared supply path shared for the ink supply (liquid supply) of the plurality of nozzles N, and are closed by the supply-side flexible plate 53 over the flow path area on the substrate lower surface of the flow path forming substrate 30. The supply flow path 133 is an individual supply path which branches from the shared supply path for each of the nozzles N to reach the pressure chamber C for each of the nozzles N. The supply-side flexible plate 53 is formed of a flexible film, or the like which absorbs pressure fluctuations in the ink inflow chamber 131 and the supply liquid chamber 132 to suppress variation in a liquid droplet ejection speed between respective nozzles N. The supply-side flexible plate 53 and the collecting-side flexible plate 54 define a part of walls of the supply liquid chamber 132 that is the common liquid chamber, and the ink collecting chamber 139 and the ink discharge chamber 140. The supply-side flexible plate 53 and the collecting-side flexible plate 54 are made of a flexible film-like thin film (for example, a thin film formed of polyphenylene sulfide (PPS), aromatic polyamide (aramid), or the like and having a thickness of 20 μm or less), and the flow path forming substrate 30, a second flow path substrate 30D, and a first flow path substrate 30U, which are described below, are made of a metal such as stainless steel (SUS), or a hard material such as a single crystal substrate of silicon (Si), or glass, having a Young's modulus higher than that of a flexible plate. Since regions of the supply liquid chamber 132 and the ink collecting chamber 139 of the flow path forming substrate 30 are openings which are completely removed in the width direction Z, the regions of the supply liquid chamber 132 and the ink collecting chamber 139 corresponding to, for example, one side of a nozzle surface are sealed only by the supply-side flexible plate 53 and the collecting-side flexible plate 54 having flexibility.

As illustrated in FIGS. 2 and 4, the nozzle communication flow path 134 is a through-hole for each of the nozzles N, which penetrates the flow path forming substrate 30, and causes the pressure chamber C for each of the nozzles N to communicate with the nozzle N of the nozzle plate 52 mounted on the substrate lower surface of the flow path forming substrate 30, on the other end side of the pressure chamber. The nozzle plate 52 is liquid-tightly mounted on the substrate lower surface of the flow path forming substrate 30, and closes the nozzle communication flow path 134 described above, the collecting communication flow path 135, and the first collecting flow path 136, which are described below, on the side of the substrate lower surface of the flow path forming substrate 30.

As illustrated in FIG. 2, the nozzle plate 52 is formed by arranging the nozzles N in a row by applying a semiconductor manufacturing technique to a single crystal substrate of silicon (Si), for example, a processing technique such as dry etching or wet etching. The nozzle plate 52 is a separate member from the supply-side flexible plate 53 and the collecting-side flexible plate 54, and a size of the nozzle plate 52 as viewed from a nozzle plate 52 side is smaller than that of the flow path forming substrate 30. Therefore, the nozzle plate 52, which is expensive because high-precision processing thereof is required, can be made small in size. The nozzle N is a circular through-hole ejecting the ink. The nozzle N may be a rectangular or polygonal through-hole.

As illustrated in FIGS. 3 and 4, the collecting communication flow path 135 is a recess groove individually formed for each of the nozzles N on the substrate lower surface of the flow path forming substrate 30, and is formed by being closed by the nozzle plate 52 liquid-tightly mounted on the substrate lower surface of the flow path forming substrate 30. The collecting communication flow path 135 causes the nozzle communication flow path 134 from the pressure chamber C to communicate with the first collecting flow path 136 for each of the nozzles N, which penetrates the flow path forming substrate 30.

As illustrated in FIGS. 2 and 4, the second collecting flow path 137 is a recess groove individually formed for each of the nozzles N so as to be continuous with the first collecting flow path 136 on the substrate upper surface of the flow path forming substrate 30, and is formed by being closed by the pressure chamber plate 40 liquid-tightly mounted on the substrate upper surface of the flow path forming substrate 30. The second collecting flow path 137 causes the third collecting flow path 138 for each of the nozzles N, which penetrates the flow path forming substrate 30, to communicate with the first collecting flow path 136, and as illustrated in FIGS. 3 and 4, a plate mounting seat 141 is formed on the substrate lower surface of the flow path forming substrate 30. The plate mounting seat 141 is a mounting seat of the nozzle plate 52 and the collecting-side flexible plate 54.

The collecting flow path substrate 70 is a plate body elongated in the Y direction and includes an ink accommodating chamber 71 therein. Similar to the ink receiving chamber 61 of the supply flow path substrate 60 described above, the ink accommodating chamber 71 is formed by closing a recess groove, which is open at a lower end and extends in the Y direction, by the flow path forming substrate 30, and returns the ink discharged from the ink discharge chamber 140 described below to the liquid container 14 via an ink discharge port 72 as indicated by a black arrow in FIG. 4. The collecting flow path substrate 70 is formed by injection molding of an appropriate resin material. Moreover, the ink return from the collecting flow path substrate 70 is performed by an ink collecting mechanism (not illustrated). In addition, the mounting of the collecting flow path substrate 70 on the flow path forming substrate 30 is liquid-tightly performed by using an appropriate adhesive.

As illustrated in FIG. 2, the ink discharge chamber 140 of the flow path forming substrate 30 is a through-hole having an opening long in the Y direction and penetrating the flow path forming substrate 30 which is the common liquid chamber communicating with the plurality of pressure chambers C, and overlaps with the ink accommodating chamber 71 of the collecting flow path substrate 70. As illustrated in FIGS. 3 and 4, the ink collecting chamber 139 is a recess groove which has an opening long in the Y direction on the substrate lower surface of the flow path forming substrate 30, and is a common liquid chamber communicating with the plurality of pressure chambers C, communicates with the ink discharge chamber 140 in the Y direction that is a longitudinal direction, and is formed by being closed by the collecting-side flexible plate 54 mounted on the substrate lower surface of the flow path forming substrate 30 over the flow path area. The third collecting flow path 138 for each of the nozzles N joins to the ink collecting chamber 139, and the ink collecting chamber 139 causes the third collecting flow path 138 for each of the nozzles N to communicate with the ink discharge chamber 140.

In the collecting flow path for collecting the ink passed through the pressure chamber C, the ink discharge chamber 140 and the ink collecting chamber 139 communicated therewith are a shared collecting path shared for ink collection (liquid collection) from the plurality of nozzles N, and are closed by the collecting-side flexible plate 54 over the flow path area on the substrate lower surface of the flow path forming substrate 30. The collecting communication flow path 135, the first collecting flow path 136, the second collecting flow path 137, and the third collecting flow path 138 are individual collecting paths for each of the nozzles N, which cause the shared collecting path to communicate with the nozzle communication flow path 134. Similar to the supply-side flexible plate 53, the collecting-side flexible plate 54 is formed of a flexible film, for example, a compliance substrate, which absorbs pressure fluctuations in the ink collecting chamber 139 and the ink discharge chamber 140.

Similar to the nozzle plate 52, the flow path forming substrate 30 forms various flow paths described above such as the ink inflow chamber 131 by applying the semiconductor manufacturing technique described above to a single crystal substrate of silicon.

The protection substrate 50 pinches the pressure chamber plate 40 forming the pressure chamber C for each of the nozzles N on the substrate upper surface of the flow path forming substrate 30, and pinches a lead electrode 45 energizing the piezoelectric element 44 for each of the pressure chambers C with respect to the pressure chamber plate 40. As illustrated in FIG. 2, the protection substrate 50 is a plate body elongated in the Y direction, forms a recess space on an upper surface side of a vibration portion 42, and covers the vibration portion 42 together with the piezoelectric element 44. In addition, the protection substrate 50 includes a through-hole 51 having an opening long in the Y direction and provided over a plurality of lead electrodes, for installing a wiring substrate (not illustrated) electrically connecting to the lead electrode 45, and is mounted on the flow path forming substrate 30 from a side opposite to the nozzle plate 52. The nozzle plate 52 is an expensive component in which highly precise nozzle machining is required, and is preferably a separate member that is not integral with the supply-side flexible plate 53 and the collecting-side flexible plate 54.

The vibration portion 42 is a ceiling wall of the pressure chamber C formed as a thin plate so as to be capable of elastically vibrating, and includes the piezoelectric element 44 for each of the closed pressure chambers C. Each of the piezoelectric elements 44 is a passive element individually corresponding to the nozzle N and deforming in response to a drive signal from the control unit 20, and is disposed in the vibration portion 42 in association with the arrangement of the nozzles N. A pressure change occurs in the ink supplied to the pressure chamber C due to the vibration of the piezoelectric element 44. The pressure change reaches the nozzle N via the nozzle communication flow path 134.

Similar to the flow path forming substrate 30, the pressure chamber plate 40 can be formed by applying the semiconductor manufacturing technique described above to a single crystal substrate of silicon, but may be formed by other materials. The protection substrate 50 is formed by injection molding of an appropriate resin material.

In the liquid ejecting head 26 having the flow path configuration described above, the ink supplied by a pump (not illustrated) from the liquid container 14 flows into the ink inflow chamber 131 and the supply liquid chamber 132 of the flow path forming substrate 30 via the ink receiving chamber 61 in the supply flow path substrate 60, and the ink inflow chamber 131 and the supply liquid chamber 132 which are the shared supply path are filled with the ink. The ink with which the shared supply path is filled is pushed out by continuously supplied ink, is supplied to the pressure chamber C via the supply flow path 133, which is the individual flow path for each of the nozzles N, and is ejected from the nozzle N by receiving the vibration of the piezoelectric element 44 of which driving is controlled by the control unit 20 in the pressure chamber C. The ink supply from the liquid container 14 is continued even under a printing situation in which the ink is ejected from the nozzle N, and even in a situation in which the ink is not ejected from the nozzle N. The ink is individually supplied to the plurality of pressure chambers C via the supply flow path 133 branched for each of the nozzles from the ink inflow chamber 131 and the supply liquid chamber 132 which are shared by the plurality of nozzles N.

In a situation in which the ink supply to the pressure chamber C is continued, the ink, which is not ejected from the nozzle N, passes through each of the pressure chambers C, and then is pushed out to the ink collecting chamber 139 and the ink discharge chamber 140 shared by the plurality of nozzles N via the collecting communication flow path 135, the first collecting flow path 136, and the third collecting flow path 138 for each of the pressure chambers C. The ink is sent out to the ink accommodating chamber 71 of the collecting flow path substrate 70. Thereafter, the ink returns to the liquid container 14.

The liquid ejecting apparatus 100 of the first embodiment described above supplies the ink from the supply flow path from the ink inflow chamber 131 to the supply flow path 133, to the pressure chamber C for each of the nozzles N, and collects the ink passing through the pressure chamber C for each of the nozzles N and not ejected from the nozzle N, in the collecting flow path from the collecting communication flow path 135 to the ink discharge chamber 140. Upon supply and collection of the ink, the ink inflow chamber 131 and the supply liquid chamber 132, which are the shared supply path in the supply flow path, are filled with the ink supplied to the pressure chamber C, and the ink collecting chamber 139 and the ink discharge chamber 140, which are the shared collecting path in the collecting flow path, are filled with the ink passed through the pressure chamber C.

The ink inflow chamber 131 and the supply liquid chamber 132 constituting the shared supply path are closed by the supply-side flexible plate 53 having flexibility over the flow path area thereof, and the ink collecting chamber 139 and the ink discharge chamber 140 constituting the shared collecting path are closed by the collecting-side flexible plate 54 having flexibility over the flow path area thereof. Therefore, the fluctuation of the ink supply pressure applied to the ink with which the ink inflow chamber 131 and the supply liquid chamber 132 are filled is attenuated by bending of the supply-side flexible plate 53. In addition, the fluctuation of the ink supply pressure applied to the ink with which the ink collecting chamber 139 and the ink discharge chamber 140 are filled, and the fluctuation of the ink ejection pressure when ejecting the ink are attenuated by bending of the collecting-side flexible plate 54. As a result, according to the liquid ejecting apparatus 100 of the first embodiment, it is possible to reduce the influence of the ink ejection pressure of the ink ejected immediately before, on the ink ejection pressure when ejecting new ink.

In the liquid ejecting apparatus 100 of the first embodiment, the plate mounting seat 141 is formed on the substrate lower surface side by the second collecting flow path 137 formed as the recess groove on the substrate upper surface of the flow path forming substrate 30 to cause the collecting communication flow path 135 through which the ink ejected from the nozzle N initially passes to communicate with the ink collecting chamber 139. Therefore, as illustrated in FIG. 4, the collecting-side flexible plate 54 can be reliably mounted on the substrate lower surface of the flow path forming substrate 30 from an original position of the nozzle plate 52.

In the liquid ejecting apparatus 100 of the first embodiment, the flow path area of the ink inflow chamber 131 and the supply liquid chamber 132, which are closing targets of the supply-side flexible plate 53, and the flow path area of the ink collecting chamber 139 and the ink discharge chamber 140, which are closing targets of the collecting-side flexible plate 54, are defined as the substrate lower surface on which the nozzle plate 52 is mounted. Therefore, according to the liquid ejecting apparatus 100 of the first embodiment, it is sufficient to mount the nozzle plate 52, the supply-side flexible plate 53, and the collecting-side flexible plate 54 on the substrate lower surface of the flow path forming substrate 30, so that it is possible to reduce the number and the cost of assembling processes involved in the mounting of the plate.

In the liquid ejecting apparatus 100 of the first embodiment, in the liquid ejecting head 26, the nozzle plate 52 is a separate member from the supply-side flexible plate 53 and the collecting-side flexible plate 54, and the size of the nozzle plate 52 when viewed from the nozzle plate 52 side is smaller than that of the flow path forming substrate 30. Therefore, the nozzle plate 52, which is expensive because high-precision processing thereof is required, can be made small in size. Moreover, since the supply-side flexible plate 53 and the collecting-side flexible plate 54 are made of a same material, the nozzle plate 52 is a separate member from either one or both the flexible plates.

In the liquid ejecting apparatus 100 of the first embodiment, in the liquid ejecting head 26, the opening of the collecting communication flow path 135, which is the individual flow path communicating with the pressure chamber C, is formed on the nozzle plate 52 side in the flow path forming substrate 30, the plate mounting seat 141 is formed as a wall between the openings of the ink collecting chamber 139 which is the common liquid chamber on the collection side with respect to the nozzle N and the collecting communication flow path 135, and both the nozzle plate 52 and the collecting-side flexible plate 54 are bonded to the flow path forming substrate 30 via the plate mounting seat 141. Therefore, it is unnecessary to cover the ink collecting chamber 139, which can be the common liquid chamber having a largest area, with the nozzle plate 52, and it is possible to secure a bonding margin of the nozzle plate 52, which is a separate member from the collecting-side flexible plate 54, and to reduce a size of the head.

In the liquid ejecting apparatus 100 of the first embodiment, in the liquid ejecting head 26, the opening of the nozzle communication flow path 134, which is the individual flow path communicating with the pressure chamber C, is formed on the nozzle plate 52 side in the flow path forming substrate 30, a wall is provided between the openings of the supply liquid chamber 132 which is the common liquid chamber on the supply side with respect to the nozzle N and the nozzle communication flow path 134, and both the nozzle plate 52 and the supply-side flexible plate 53 are bonded to the flow path forming substrate 30 via the wall. Therefore, it is unnecessary to cover the supply liquid chamber 132, which can be the common liquid chamber having a largest area, with the nozzle plate 52, and it is possible to secure a bonding margin of the nozzle plate, which is a separate member from the supply-side flexible plate 53, and to reduce the size of the head.

In the liquid ejecting apparatus 100 of the first embodiment, in the liquid ejecting head 26, a Young's modulus of the nozzle plate 52 is larger than those of both the supply-side flexible plate 53 and the collecting-side flexible plate 54. Therefore, since a material harder than those of both flexible plates can be used for the nozzle plate 52, it is possible to reduce energy loss due to absorption of the pressure in the nozzle portion.

B. Second Embodiment

Figure 5:
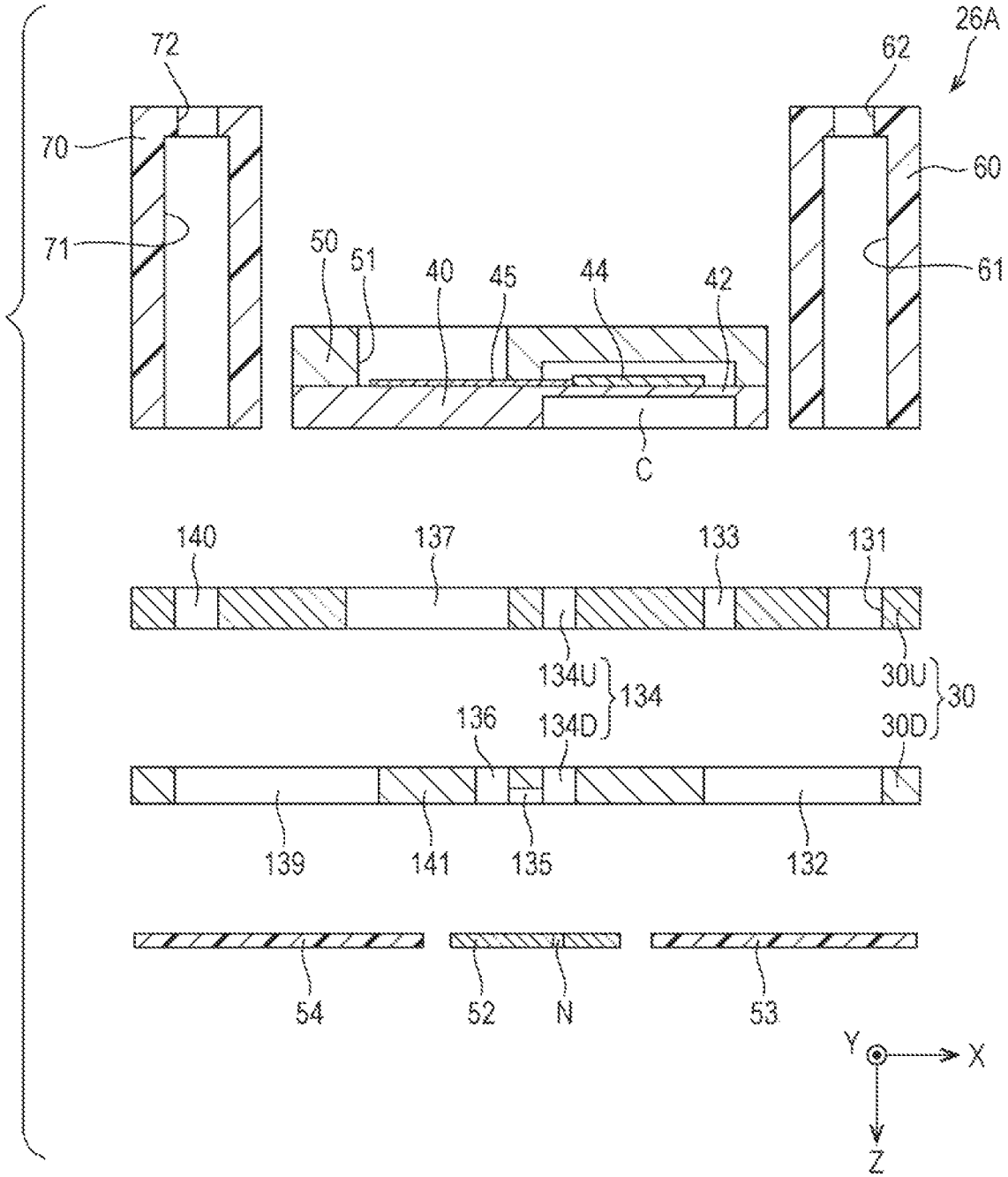
FIG. 5 is an explanatory view illustrating a liquid ejecting head in a liquid ejecting apparatus of a second embodiment by exploding main configuration members and in a sectional view corresponding to FIG. 4.

FIG. 5 is an explanatory view illustrating a liquid ejecting head 26A in a liquid ejecting apparatus of a second embodiment by exploding main configuration members and in a sectional view corresponding to FIG. 4. In the following description, the same reference numerals will be used for the flow path configurations and constituent members described above for convenience of explanation as long as their functions are the same.

The liquid ejecting head 26A illustrated in FIG. 5 has a feature in that a flow path forming substrate 30 is a substrate laminated form obtained by liquid-tightly bonding a first flow path substrate 30U on a pressure chamber plate 40 side and a second flow path substrate 30D laminated on the first flow path substrate 30U from a nozzle plate 52 side. Respective flow paths from an ink inflow chamber 131 to an ink discharge chamber 140 are separately formed by the first flow path substrate 30U and the second flow path substrate 30D, or by bonding of both flow path substrates as below.

The ink inflow chamber 131 is a through-hole penetrating the first flow path substrate 30U having an opening long in the Y direction (see FIG. 2). A supply liquid chamber 132 is a through-hole penetrating the second flow path substrate 30D having an opening long in the Y direction, communicates with the ink inflow chamber 131 of the first flow path substrate 30U, and is closed by a supply-side flexible plate 53 over a flow path area in the +X direction. A supply flow path 133 is a through-hole for each of the nozzles N penetrating the first flow path substrate 30U, and causes each of pressure chambers C in a pressure chamber plate 40 to communicate with the supply liquid chamber 132 of the second flow path substrate 30D.

A nozzle communication flow path 134 for each of the nozzles N is divided into an upstream flow path 134U, which is a through-hole penetrating the first flow path substrate 30U, and a downstream flow path 134D, which is a through-hole penetrating the second flow path substrate 30D, and is formed by laminating the first flow path substrate 30U on the second flow path substrate 30D. A collecting communication flow path 135 for each of the nozzles N is a recess groove formed for each of the nozzles N on a substrate lower surface of the second flow path substrate 30D. A first collecting flow path 136 for each of the nozzles N is a through-hole penetrating the second flow path substrate 30D, and communicates with the downstream flow path 134D of the nozzle communication flow path 134 by the collecting communication flow path 135.

A second collecting flow path 137 for each of the nozzles N is a through-hole which opens the first flow path substrate 30U in the X direction, and communicates with the first collecting flow path 136 for each of the nozzles N penetrating the second flow path substrate 30D. In addition, the second collecting flow path 137 communicates with an ink collecting chamber 139, which is a through-hole penetrating the second flow path substrate 30D having an opening long in the Y direction, and the ink collecting chamber 139 forms a plate mounting seat 141 with the first collecting flow path 136. That is, since both through-holes of the second collecting flow path 137 and the ink collecting chamber 139 communicate with each other, the formation of a third collecting flow path 138 can be omitted in the liquid ejecting head 26A. An ink discharge chamber 140 is a through-hole penetrating the first flow path substrate 30U having an opening long in the Y direction (see FIG. 2), and communicates with the ink collecting chamber 139.

In the liquid ejecting apparatus of the second embodiment described above, the flow path forming substrate 30 is the substrate laminated form obtained by liquid-tightly laminating the first flow path substrate 30U on the second flow path substrate 30D, and the supply flow path and the collecting flow path of the ink are formed separately by the first flow path substrate 30U and the second flow path substrate 30D, or with both flow path substrates. Specifically, as described above, various flow paths are formed with the through-holes penetrating the first flow path substrate 30U, and various flow paths other than the collecting communication flow path 135 can be formed with the through-holes penetrating the second flow path substrate 30D. As a result, according to the liquid ejecting apparatus of the second embodiment having the liquid ejecting head 26A, in the first flow path substrate 30U and the second flow path substrate 30D, it is possible to simplify a shape of the flow path in each substrate, and to reduce the number and the cost of processes of the flow path formation by the simplification.

In the liquid ejecting apparatus of the second embodiment having the liquid ejecting head 26A, both the ink inflow chamber 131 and the supply liquid chamber 132, which are a shared supply path, and both the ink collecting chamber 139 and the ink discharge chamber 140, which are a shared collecting path, are flow paths separated by a bonding surface between the first flow path substrate 30U and the second flow path substrate 30D. In addition, the ink inflow chamber 131 and the ink discharge chamber 140 as the separated flow paths are formed as the through-holes of the first flow path substrate 30U, and the supply liquid chamber 132 and the ink collecting chamber 139 as the separated flow paths are formed as the through-holes of the second flow path substrate 30D. Therefore, according to the liquid ejecting apparatus of the second embodiment having the liquid ejecting head 26A, it is possible to further simplify the shape of the flow path, and to further reduce the number and the cost of processes of the flow path formation.

C. Third Embodiment

Figure 6:
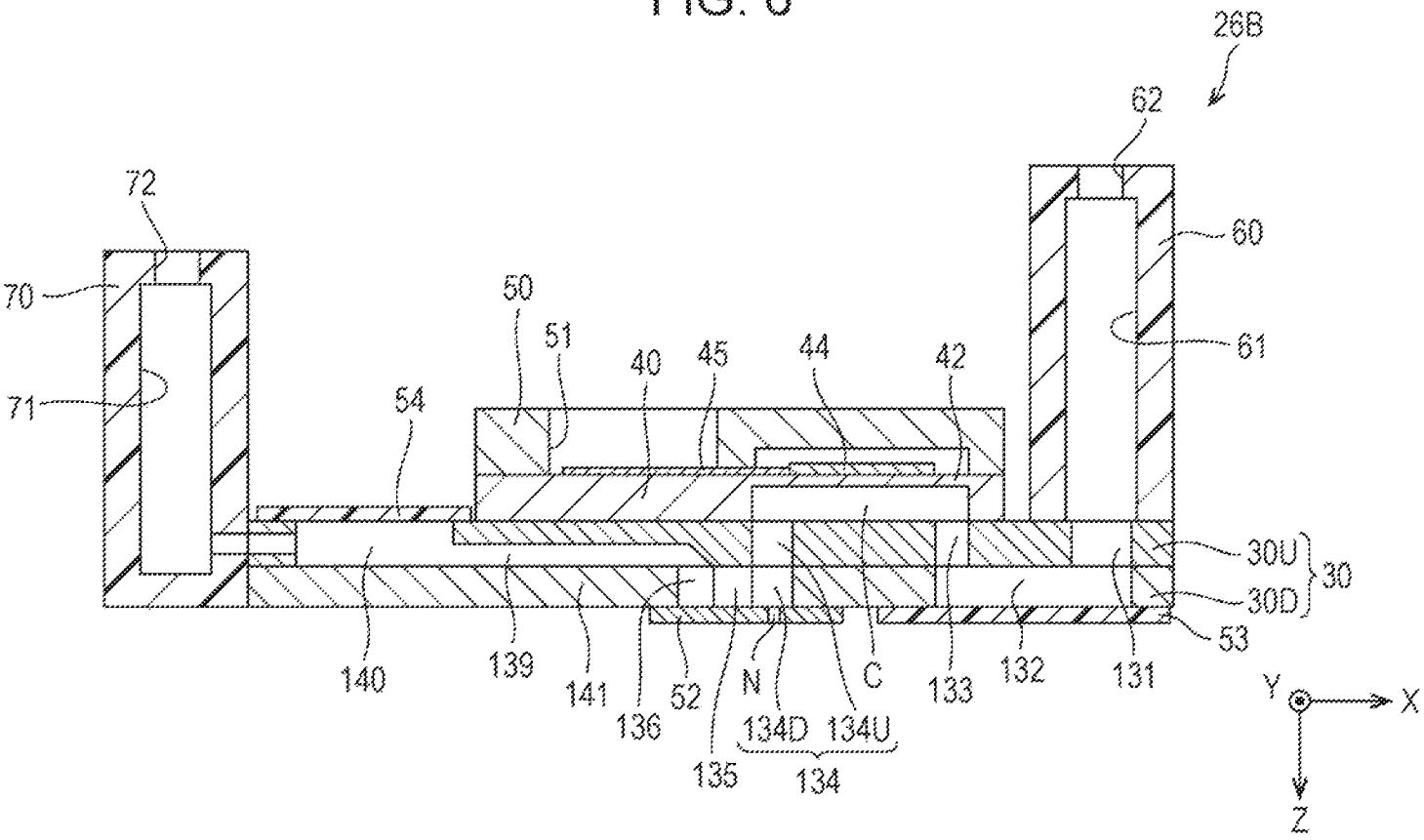
FIG. 6 is an explanatory view illustrating a liquid ejecting head of a third embodiment in a sectional view corresponding to FIG. 4.

FIG. 6 is an explanatory view illustrating a liquid ejecting head 26B of a third embodiment in a sectional view corresponding to FIG. 4.

Similar to the liquid ejecting head 26A, the liquid ejecting head 26B illustrated in FIG. 6 has a feature in that a flow path forming substrate 30 is a substrate laminated form of a first flow path substrate 30U and a second flow path substrate 30D, and an ink discharge chamber 140 closed by a collecting-side flexible plate 54 and an ink collecting chamber 139 are formed in the first flow path substrate 30U.

In the liquid ejecting head 26B, the ink collecting chamber 139 and the ink discharge chamber 140 are formed in the first flow path substrate 30U. The ink collecting chamber 139, which is a shared collecting path, is formed as a recess groove long in the Y direction on a substrate lower surface of the first flow path substrate 30U and communicates with a collecting communication flow path 135 of the second flow path substrate 30D via a first collecting flow path 136. Therefore, in the liquid ejecting head 26B, formation of a second collecting flow path 137 and the third collecting flow path 138 can be omitted. Moreover, the ink collecting chamber 139 illustrated in FIG. 6 may be replaced by the second collecting flow path 137 for each of the nozzles N, and the second collecting flow path 137 may directly communicate with the ink discharge chamber 140.

The ink discharge chamber 140, which is the shared collecting path, is formed as a through-hole having an opening long in the Y direction of the first flow path substrate 30U and communicates with the ink collecting chamber 139, and a flow path area thereof is closed by a substrate upper surface of the first flow path substrate 30U by the collecting-side flexible plate 54. A downstream flow path 134D and the first collecting flow path 136 for each of the nozzles N are through-holes penetrating the second flow path substrate 30D, the collecting communication flow path 135 for each of the nozzles N is a through-hole penetrating the second flow path substrate 30D so as to cause the downstream flow path 134D to communicate with the first collecting flow path 136. A height of the collecting communication flow path 135 in the Z direction is the same as a height of the second flow path substrate 30D in the Z direction, but a groove width in the Y direction is narrowed, so that an opening area thereof is substantially 30% to 40% of flow path areas of the downstream flow path 134D and the first collecting flow path 136 on both sides. Moreover, similar to the embodiments described above, the collecting communication flow path 135 may be a recess groove recessed on a nozzle plate 52 side.

Also according to the liquid ejecting apparatus of the third embodiment having the liquid ejecting head 26B described above, in the second flow path substrate 30D, all the flow paths can be through-holes, so that it is possible to reduce the number and the cost of processes of the flow path formation through further simplification of the shape of the flow path.

D. Fourth Embodiment

Figure 7:
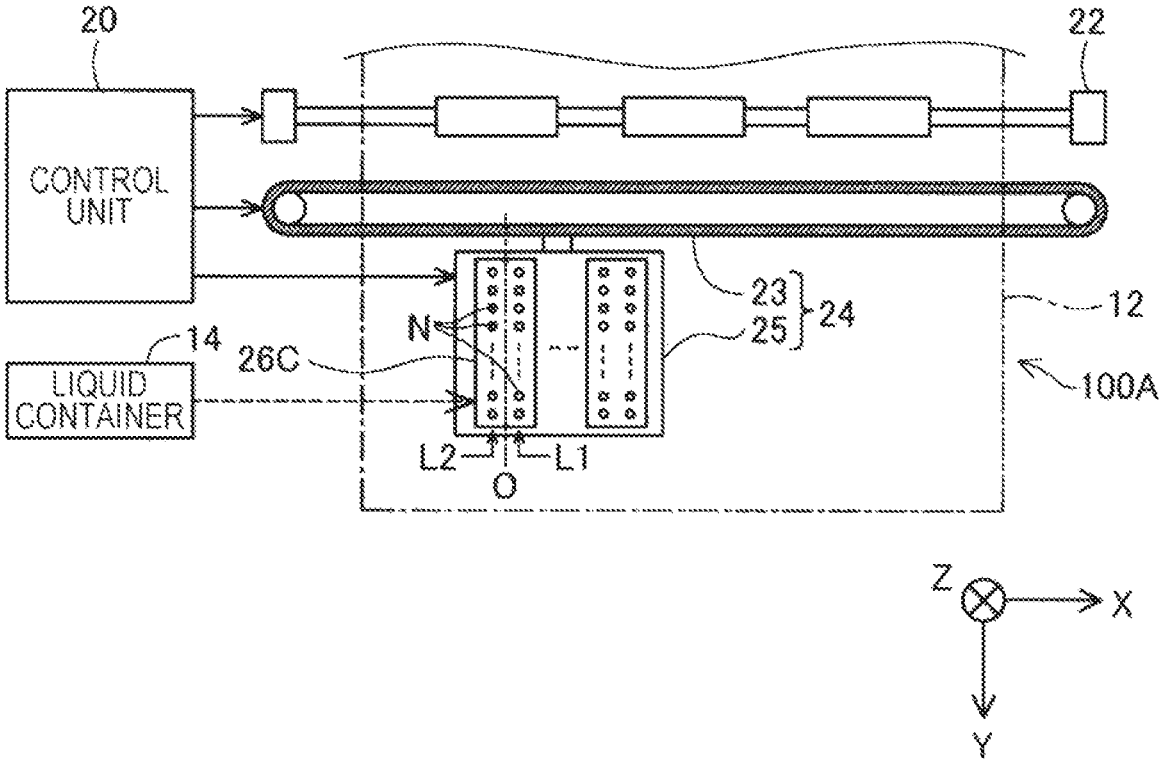
FIG. 7 is an explanatory view schematically illustrating a configuration of a liquid ejecting apparatus of a fourth embodiment.
Figure 8:
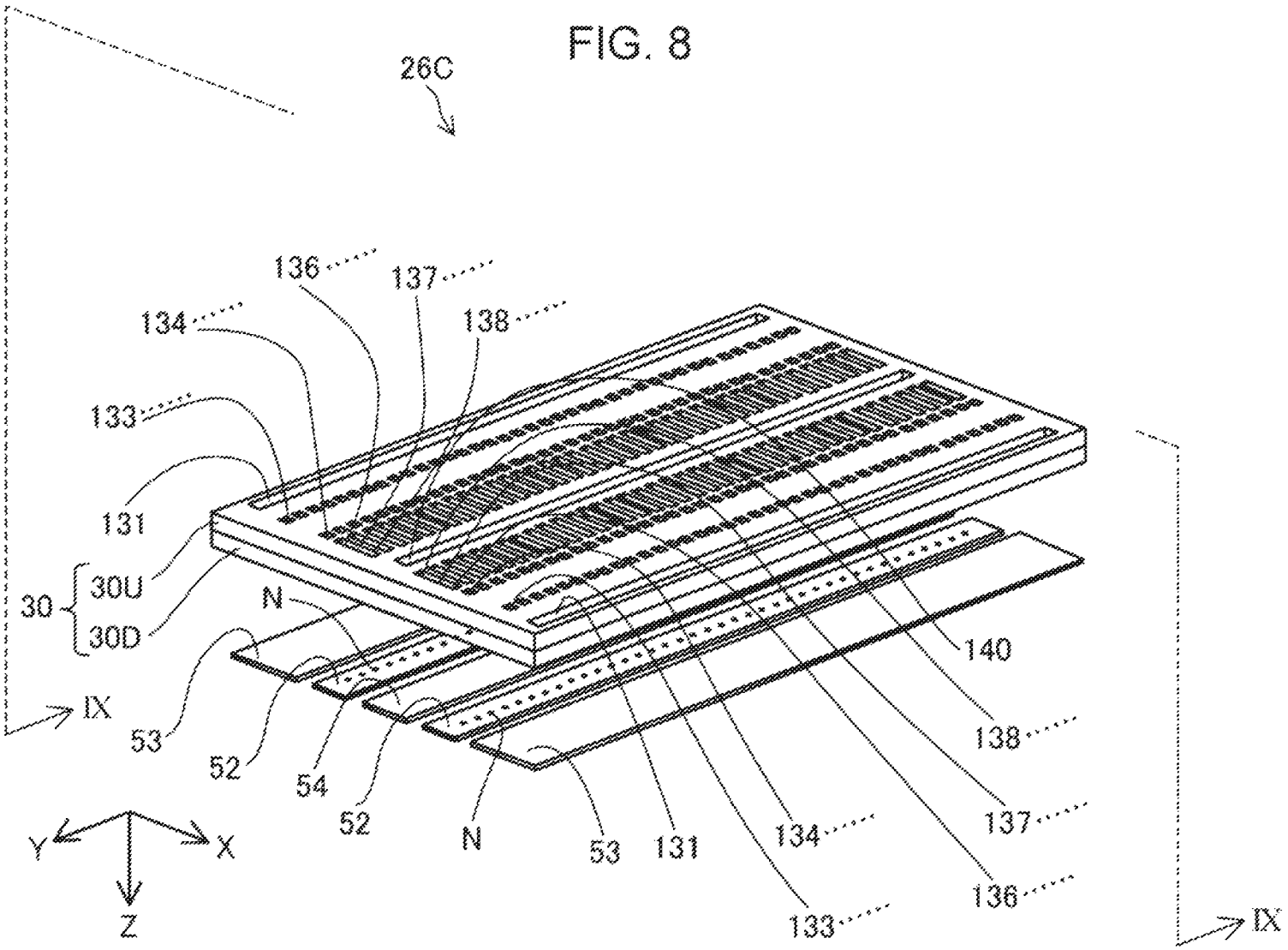
FIG. 8 is an explanatory view schematically illustrating main head configuration elements of a liquid ejecting head in an exploded view from above.
Figure 9:
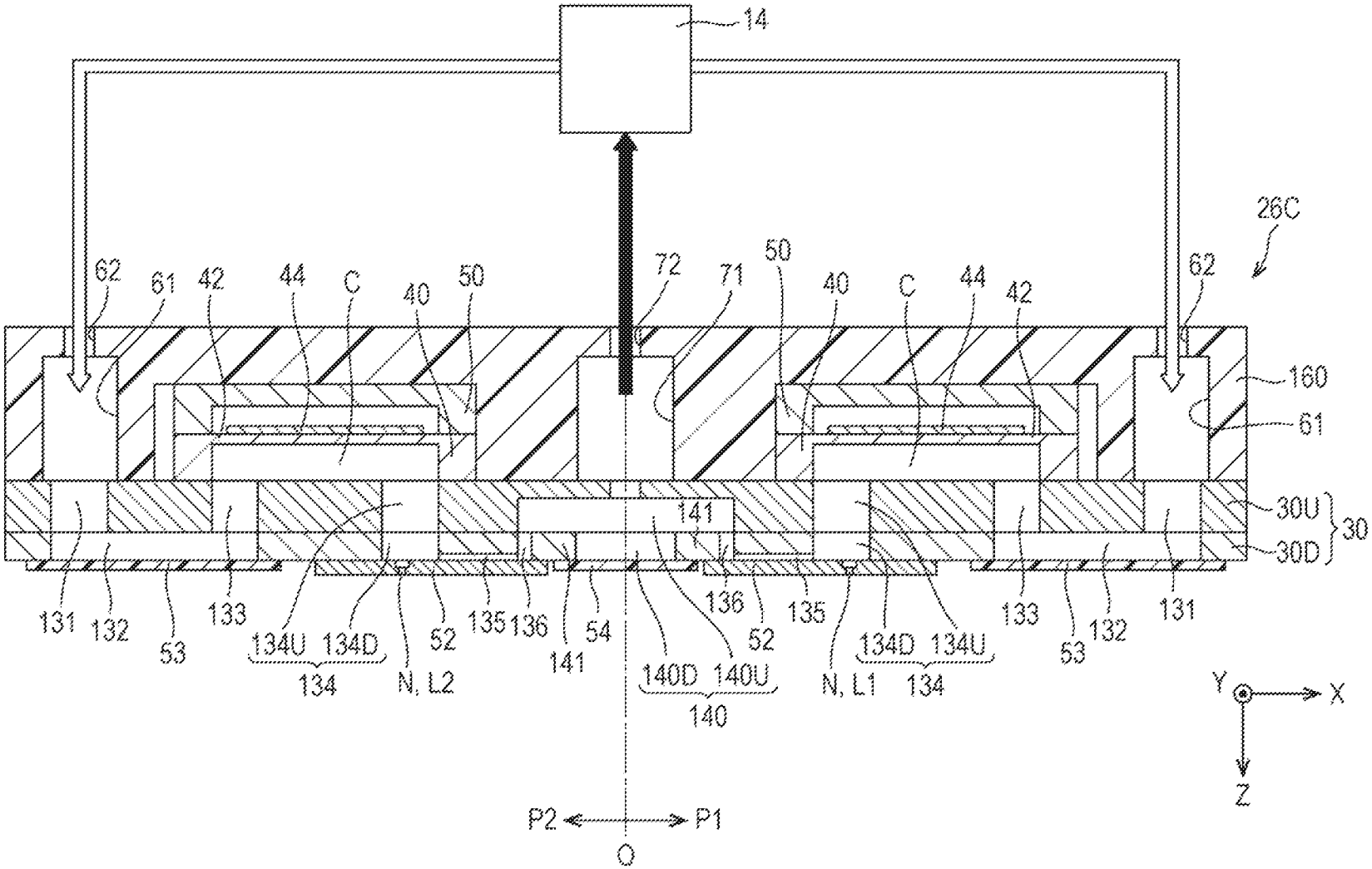
FIG. 9 is an explanatory view illustrating the liquid ejecting head in a sectional view which is taken along line IX-IX in FIG. 8.

FIG. 7 is an explanatory view schematically illustrating a configuration of a liquid ejecting apparatus 100A of a fourth embodiment. FIG. 8 is an explanatory view schematically illustrating main head configuration elements of a liquid ejecting head 26C in an exploded view which is viewed from above. FIG. 9 is an explanatory view illustrating the liquid ejecting head 26C in a sectional view which is taken along line IX-IX in FIG. 8.

The liquid ejecting apparatus 100A of the fourth embodiment has a feature in that a nozzle row, in which a plurality of nozzles N are arranged in a sub-scanning direction, is included in the liquid ejecting head 26C, and the nozzle row is provided in two rows with predetermined intervals in a main scanning direction. The two nozzle rows are illustrated as a first nozzle row L1 and a second nozzle row L2 in the drawing, the nozzles N of the first nozzle row L1 and the nozzles N of the second nozzle row L2 are arranged in the main scanning direction. In the following description, a YZ plane including a central axis by causing a center of the first nozzle row L1 and the second nozzle row L2 to be the central axis, and passing through in the Y direction is defined as a center plane O for convenience of explanation. Moreover, the arrangement of the nozzles N in the first nozzle row L1 and the second nozzle row L2 may be provided in a zigzag shape shifted in a medium feeding direction (Y direction). In addition, the first nozzle row L1 and the second nozzle row L2 are nozzle rows matched with a plural kinds of inks included in the liquid container 14.

Similar to the liquid ejecting heads 26A and 26B, the liquid ejecting head 26C including the first nozzle row L1 and the second nozzle row L2 has a feature in that a flow path forming substrate 30 is a substrate laminated form of a first flow path substrate 30U and a second flow path substrate 30D, and ink collection from a first nozzle row L1 side and ink collection from a second nozzle row L2 side are performed at the center of both nozzle rows. In the liquid ejecting head 26C, an ink supply flow path configuration to each of the nozzles N of the first nozzle row L1 and an ink supply flow path configuration to each of the nozzles N of the second nozzle row L2 are provided to have plane symmetry with the center plane O interposed therebetween. That is, the configuration of the liquid ejecting head 26 is common to a first portion P1 on a +X direction and a second portion P2 on a −X direction with the center plane O interposed therebetween. Specifically, similar to the liquid ejecting head 26A, the ink supply flow path to a pressure chamber C corresponding to each of the nozzles N of the first nozzle row L1 is constituted of an ink inflow chamber 131 formed to penetrate the first flow path substrate 30U, a supply liquid chamber 132 formed to penetrate the second flow path substrate 30D, and a supply flow path 133 formed to penetrate the first flow path substrate 30U from a side in the +X direction. In addition, the ink supply flow path to the pressure chamber C corresponding to each of the nozzles N of the second nozzle row L2 is constituted of an ink inflow chamber 131 formed to penetrate the first flow path substrate 30U, a supply liquid chamber 132 formed to penetrate the second flow path substrate 30D, and a supply flow path 133 formed to penetrate the first flow path substrate 30U from a side in the −X direction.

The liquid ejecting head 26C includes a pressure chamber plate 40 forming the pressure chamber C, and a protection substrate 50 pinching the plate corresponding to the first nozzle row L1 and the second nozzle row L2, and two pressure chamber plates 40 and the protection substrates 50 are held by a casing portion 160 on the flow path forming substrate 30. The casing portion 160 includes the ink receiving chamber 61 described above in association with the ink inflow chambers 131 in the +X direction and the −X direction, and the ink accommodating chamber 71 described above is provided at a position of the center plane O.

In addition, the liquid ejecting head 26C forms the ink discharge chamber 140 overlapping with the ink accommodating chamber 71 at the position of the center plane O by bonding an upstream discharge chamber 140U formed as a recess groove long in the Y direction on the substrate lower surface in the first flow path substrate 30U and a downstream discharge chamber 140D formed as a through-hole having an opening long in the Y direction in the second flow path substrate 30D. The collecting communication flow paths 135 in the first nozzle row L1 and the second nozzle row L2 respectively communicate with the upstream discharge chamber 140U via the first collecting flow path 136, and a plate mounting seat 141 for each nozzle row is formed between the downstream discharge chamber 140D and the first collecting flow path 136. That is, the plate mounting seat 141 partitions the downstream discharge chamber 140D in the ink discharge chamber 140 which is a shared collecting path in the Y direction, and the first collecting flow path 136 which is a through-hole for each of the nozzles N. In the liquid ejecting head 26C, a nozzle plate 52 corresponding to the first nozzle row L1 and a nozzle plate 52 corresponding to the second nozzle row L2 are mounted by using the plate mounting seats 141 so as to close the collecting communication flow path 135 and the first collecting flow path 136, and a collecting-side flexible plate 54 is mounted between both the nozzle plates by using the plate mounting seats 141 so as to close the downstream discharge chamber 140D.

According to the liquid ejecting apparatus 100A of the fourth embodiment described above, even if the liquid ejecting head 26C including the first nozzle row L1 and the second nozzle row L2 is mounted, similar to the liquid ejecting apparatus 100 of the first embodiment, it is possible to reduce the influence of the ink ejection pressure of the ink ejected immediately before, on the ink ejection pressure when ejecting new ink. In addition, according to the liquid ejecting apparatus 100A of the fourth embodiment, similar to the liquid ejecting apparatus of the second embodiment, it is possible to reduce the number and the cost of processes of the flow path formation through simplification of the shape of the flow path.

E. Other Embodiments (E-1) In the embodiments described above, the ink is supplied from the side of the ink inflow chamber 131 formed by the flow path forming substrate 30 to the pressure chamber C, and the ink passed through the pressure chamber C is collected from the side of the ink discharge chamber 140, but the flow of the ink may be reversed. Specifically, the ink may be supplied from the side of the ink discharge chamber 140 illustrated in FIG. 4 to the pressure chamber C, and the ink passed through the pressure chamber C may be collected from the side of the ink inflow chamber 131.

(E-2) The present disclosure is not limited to the liquid ejecting apparatus ejecting the ink, but can also be applied any liquid ejecting apparatus ejecting a liquid other than the ink. For example, the present disclosure can be applied to various liquid ejecting apparatuses as described below.

(1) An image recording apparatus such as a facsimile apparatus.

(2) A color material ejecting apparatus used for manufacturing a color filter for an image display device such as a liquid crystal display.

(3) An electrode material ejecting apparatus used for forming electrodes of organic Electro Luminescence (EL) display, a Field Emission Display (FED), and the like.

(4) A liquid ejecting apparatus ejecting a liquid containing bioorganic matter used for biochip manufacture.

(5) A sample ejecting apparatus as precision pipette.

(6) A lubricating oil ejecting apparatus.

(7) A resin liquid ejecting apparatus.

(8) A liquid ejecting apparatus ejecting lubricating oil at pinpoint to a precision machine such as a watch or a camera.

(9) A liquid ejecting apparatus ejecting a transparent resin liquid such as an ultraviolet curable resin liquid onto a substrate to form a micro hemispherical lens (optical lens) or the like used for an optical communication element or the like.

(10) A liquid ejecting apparatus ejecting an acidic or alkaline etchant for etching a substrate or the like.

(11) A liquid ejecting apparatus including a liquid ejecting head ejecting any small amount of liquid droplets.

Moreover, the term "liquid droplet" refers to a state of a liquid ejected from a liquid ejecting apparatus and includes a state in which a tail is drawn in forms of granules, teardrops, and threads. Further, the term "liquid" as used herein may be a material that can be consumed by a liquid ejecting apparatus. For example, the term "liquid" may be any material as long as the substance is in a liquid phase, and it may be a material of a liquid state having a high or low viscosity, a sol, gel water, and a material of a liquid state such as inorganic solvents, organic solvents, solution, liquid resin, and liquid metal (metal melt) are also included in the "liquid". Also, the "liquid" includes not only liquid as one state of a substance but also one which is obtained in such a manner that particles of a functional material composed of solid matter such as pigment and metallic particles are dissolved, dispersed, or mixed in a solvent. Representative examples of the liquid include ink and liquid crystal. Here, the ink includes various liquid compositions such as general water-based ink and oil-based ink, gel ink, and hot melt ink.

F. Other Forms

The present disclosure is not limited to the embodiments and modification examples described above, and can be realized in various configurations without departing from the spirit of the present disclosure. For example, it is also possible to reverse the supply direction and the collecting direction of the ink with respect to the head, and to eject the ink while circulating the ink by supplying the ink from the collecting direction. The technical features in the embodiments and the modification examples corresponding to the technical features in each form described in the summary of the present disclosure can be replaced or combined as necessary in order to solve a part or all of the above problems, or to achieve a part or all of the effects described above. Also, unless its technical features are described as essential in the present specification, it can be deleted as appropriate.

(1) According to one aspect of the present disclosure, there is provided a liquid ejecting head. The liquid ejecting head having a plurality of nozzles ejecting a liquid, the liquid ejecting head including: a nozzle plate having the plurality of nozzles; a flow path forming substrate on which the nozzle plate is mounted and which includes a shared supply path shared for liquid supply to the plurality of nozzles, an individual supply path branching from the shared supply path and leading to a pressure chamber for each of the nozzles, a communication flow path for each of the nozzles communicating the nozzles and the pressure chamber to each other, an individual collecting path communicating with the communication flow path for each of the nozzles, and a shared collecting path shared for liquid collection from the plurality of nozzles by joining to the individual collecting path; a pressure generating section provided for each of the nozzles to change a pressure of the pressure chamber; a supply-side flexible plate having flexibility and liquid-tightly closing the shared supply path formed by the flow path forming substrate over a flow path area; and a collecting-side flexible plate having flexibility and liquid-tightly closing the shared collecting path formed by the flow path forming substrate over the flow path area.

In the liquid ejecting head of the aspect, the liquid is supplied from the supply flow path to the plurality of pressure chambers, and the liquid, which passes through the plurality of pressure chambers and is not ejected from the nozzle, is collected by the collecting flow path. The shared supply path in the supply flow path is filled with the liquid supplied to the pressure chamber, and the shared collecting path in the collecting flow path is filled with the liquid passed through the pressure chamber. Since the shared supply path and the shared collecting path are closed by the flexible plates having flexibility over the flow path area, the fluctuation of the liquid supply pressure applied to the liquid of the shared supply path is attenuated by bending of the supply-side flexible plate. In addition, the fluctuations of the liquid supply pressure applied to the liquid of the shared collecting path and the liquid ejecting pressure when ejecting the liquid are attenuated by bending of the collecting-side flexible plate. As a result, according to the liquid ejecting apparatus of the aspect, it is possible to reduce the influence of the ink ejection pressure of the ejected ink, on the ink ejection pressure when ejecting new ink.

(2) In the liquid ejecting head of the aspect, the flow path forming substrate may include the flow path area of the shared supply path closed by the supply-side flexible plate and the flow path area of the shared collecting path closed by the collecting-side flexible plate, on the substrate surface on a side on which the nozzle plate is mounted. Therefore, since the plate mounting surfaces are the same, it is possible to reduce the number and the cost of assembling processes.

(3) In the liquid ejecting head of the aspect, the nozzle plate and one or both of the supply-side flexible plate and the collecting-side flexible plate may be separate members, and the size of the nozzle plate when viewed from the nozzle plate side is smaller than that of the flow path forming substrate. Therefore, the nozzle plate, which is expensive because high-precision processing thereof is required, can be made small in size.

(4) In the liquid ejecting head of the aspect, the opening of the individual flow path communicating with the pressure chamber may be formed on the nozzle plate side in the flow path forming substrate, and a wall may be provided between the collecting-side common liquid chamber with respect to nozzle and the opening, and both the nozzle plate and the collecting-side flexible plate may be bonded to the wall. Therefore, it is unnecessary to cover the common liquid chamber having a largest area, with the nozzle plate, and it is possible to secure a bonding margin of the nozzle plate, which is a separate member, and to reduce the size of the head.

(5) In the liquid ejecting head of the aspect, the opening of the individual flow path communicating with the pressure chamber may be formed on the nozzle plate side in the flow path forming substrate, a wall may be provided between the supply-side common liquid chamber with respect to nozzle and the opening, and both the nozzle plate and the supply-side flexible plate may be bonded to the wall. Therefore, it is unnecessary to cover the common liquid chamber having a largest area, with the nozzle plate, and it is possible to secure a bonding margin of the nozzle plate, which is a separate member, and to reduce the size of the head.

(6) In the liquid ejecting head of the aspect, the Young's modulus of the nozzle plate may be larger than those of both the supply-side flexible plate and the collecting-side flexible plate. Therefore, since a material harder than the flexible plate can be used for the nozzle plate, it is possible to reduce energy loss due to absorption of the pressure in the nozzle portion.

(7) In the liquid ejecting head of the aspect, the flow path forming substrate may include the first flow path substrate on the pressure chamber side and the second flow path substrate laminated on the first flow path substrate from the nozzle plate side, and in the substrate laminated state in which the first flow path substrate and the second flow path substrate are liquid-tightly laminated, the supply-side and collecting-side flow paths may be formed. Therefore, in the first flow path substrate and the second flow path substrate, it is possible to simplify the shape of the flow path in each flow path substrate, and to reduce the number and the cost of processes of the flow path formation by the simplification. The supply-side and collecting-side flow paths are the shared supply path, the individual supply path, the communication flow path, the individual collecting path, and the shared collecting path.

(8) In the liquid ejecting apparatus of the aspect, in the flow path forming substrate, at least one of the shared supply path and the shared collecting path may be a flow path separated by a bonding surface between the first flow path substrate and the second flow path substrate, and the shared supply path and the shared collecting path as the separated flow paths may be formed as through-holes of the first flow path substrate or the second flow path substrate. Therefore, it is possible to further simplify the shape of the flow path, and to further reduce the number and the cost of processes of the flow path formation.

(9) According to another aspect of the present disclosure, a liquid ejecting apparatus is provided. The liquid ejecting apparatus including the liquid ejecting head according to any one of the aspects described above; and a liquid container storing the liquid supplied to the liquid ejecting head and returning the liquid from the liquid ejecting head. According to the liquid ejecting apparatus, since the liquid ejecting head capable of suppressing or avoiding deformation of the shape of the flow path is provided, it is possible to enhance the quality of an object obtained by the liquid ejection.

In addition, the present disclosure can be realized in various aspects, for example, can be realized in a form of a liquid ejecting method or the like.

What is claimed is:

1. A liquid ejecting head comprising:

a nozzle plate having a plurality of nozzles ejecting a liquid;

a flow path forming substrate having a first surface to which the nozzle plate is bonded and a second surface, the flow path forming substrate including a shared supply path shared for supplying the liquid to the plurality of nozzles, an individual communication flow path communicating the nozzles and a pressure chamber to each other and provided for each of the nozzles, and a shared collecting path shared between the plurality of nozzles for collecting a liquid, which is not discharged from the nozzles, from the individual communication flow path;

a first flexible plate bonded to the first surface of the flow path forming substrate so as to constitute a part of a wall of the shared supply path; and a second flexible plate bonded to the first surface of the flow path forming substrate so as to constitute a part of a wall of the shared collecting path, wherein a Young's modulus of the material of the nozzle plate is larger than that of the material of the first flexible plate or the material of the second flexible plate.

2. The liquid ejecting head according to claim 1, wherein an opening corresponding to the individual communication flow path, an opening corresponding to the shared supply path sealed by the first flexible plate, and an opening corresponding to the shared collecting path sealed by the second flexible plate are formed in the first surface of the flow path forming substrate.

3. The liquid ejecting head according to claim 1, wherein a material of the nozzle plate is different from a material of the first flexible plate or a material of the second flexible plate.

4. The liquid ejecting head according to claim 1, wherein when viewed toward the first surface, a size of the nozzle plate is smaller than a size of the flow path forming substrate.

5. The liquid ejecting head according to claim 1, wherein the flow path forming substrate is constituted by bonding a first flow path substrate and a second flow path substrate in a laminated state.

6. The liquid ejecting head according to claim 5, wherein the first flow path substrate and the second flow path substrate have through holes respectively corresponding to the individual communication flow path, the shared supply path, and the shared collecting path.

7. A liquid ejecting apparatus comprising:

the liquid ejecting head according to claim 1; and a liquid container storing the liquid supplied to the liquid ejecting head and returned from the liquid ejecting head.

* * * * *